US006464222B1

(12) United States Patent
Parker

(10) Patent No.: US 6,464,222 B1
(45) Date of Patent: Oct. 15, 2002

(54) DINNER PARTY CONVERSATION GENERATOR

(75) Inventor: Mary L. Parker, Nashville, TN (US)

(73) Assignee: Subject Matters LLC, Las Vegas, NV (US)

( * ) Notice: Subject to any disclaimer, the term of this patent is extended or adjusted under 35 U.S.C. 154(b) by 0 days.

(21) Appl. No.: 09/531,616

(22) Filed: Mar. 21, 2000

(51) Int. Cl.[7] ..... A63F 3/00

(52) U.S. Cl. ..... 273/236; 273/139; 273/430; 273/459; 273/138.1

(58) Field of Search ..... 273/236, 139, 273/141, 430, 459, 138.1; 40/324

(56) References Cited

U.S. PATENT DOCUMENTS

| | | | | | |
|---|---|---|---|---|---|
| 50,437 | A | * | 10/1865 | Atterbury | 40/324 |
| 150,184 | A | * | 4/1874 | Osmun | 40/324 |
| 222,594 | A | * | 12/1879 | Marra | 40/324 |
| 783,170 | A | * | 2/1905 | Beach | 40/324 |
| 1,034,313 | A | * | 7/1912 | Smith | 40/324 |
| 1,196,803 | A | * | 9/1916 | Mulholland | 40/324 |
| 1,301,596 | A | | 4/1919 | Patton | |
| 1,342,223 | A | * | 6/1920 | Nakamura | 40/324 |
| 1,536,716 | A | * | 5/1925 | Kade | 40/324 |
| 1,829,861 | A | * | 11/1931 | Holt | 40/324 |
| 2,010,534 | A | * | 8/1935 | Collins | 220/1 |
| 2,171,350 | A | * | 8/1939 | Anderson | 40/16 |
| 2,224,683 | A | * | 12/1940 | Ide et al. | 65/16 |
| 2,485,922 | A | | 10/1949 | Rubin | |
| 2,781,650 | A | | 2/1957 | Lee | |
| 2,945,314 | A | | 7/1960 | Baldwin | |
| 2,984,035 | A | * | 5/1961 | Nalle, Jr. | 40/324 |
| 3,040,472 | A | * | 6/1962 | Miller | 46/68.4 |
| 3,514,887 | A | | 6/1970 | Jacob | |
| 3,515,262 | A | | 6/1970 | Ornstein et al. | |
| 3,574,957 | A | * | 4/1971 | Bello-Bridick | 35/76 |
| 3,813,801 | A | | 6/1974 | Vander Schaaf | |
| 3,818,623 | A | * | 6/1974 | Wilton et al. | 40/324 |
| 3,945,643 | A | * | 3/1976 | Breslow | 273/134 B |
| 4,275,518 | A | | 6/1981 | Martin | |
| 4,678,188 | A | * | 7/1987 | Johnson | 273/1 R |
| 5,112,064 | A | | 5/1992 | Weedman | |
| 5,123,190 | A | | 6/1992 | Erberber | |
| 5,191,979 | A | * | 3/1993 | Nemeroff | 206/459.5 |
| 5,339,548 | A | * | 8/1994 | Russell | 40/324 |
| 5,375,846 | A | * | 12/1994 | Smith | 273/292 |
| 5,520,278 | A | | 5/1996 | Hughes | |
| 5,560,653 | A | | 10/1996 | Beppu | |
| 5,640,790 | A | | 6/1997 | Johns | |
| 5,729,922 | A | * | 3/1998 | Peterson et al. | 40/324 |
| 5,769,715 | A | | 6/1998 | Brown | |
| 5,829,626 | A | | 11/1998 | Brennan | |
| 5,894,948 | A | | 4/1999 | Yeh | |
| 5,992,892 | A | | 11/1999 | Schaefer et al. | |

* cited by examiner

*Primary Examiner*—Benjamin H. Layno
*Assistant Examiner*—D Collins
(74) *Attorney, Agent, or Firm*—Frommer Lawrence & Haug LLP

(57) ABSTRACT

Tableware capable of facilitating conversation between guests and a method of using the same is provided that includes: a) providing a set of open-ended questions or commands each being separately printed on a surface of a dining-piece; b) distributing one or more of the dining-pieces to each dining partner; c) having each dining partner read aloud the open-ended question or comment printed on their dining-piece; d) having one of the dining partners answer the open-ended question; and e) engaging all of the dining partners in open discussion of alternate answers to the question.

25 Claims, 2 Drawing Sheets

FIG 2
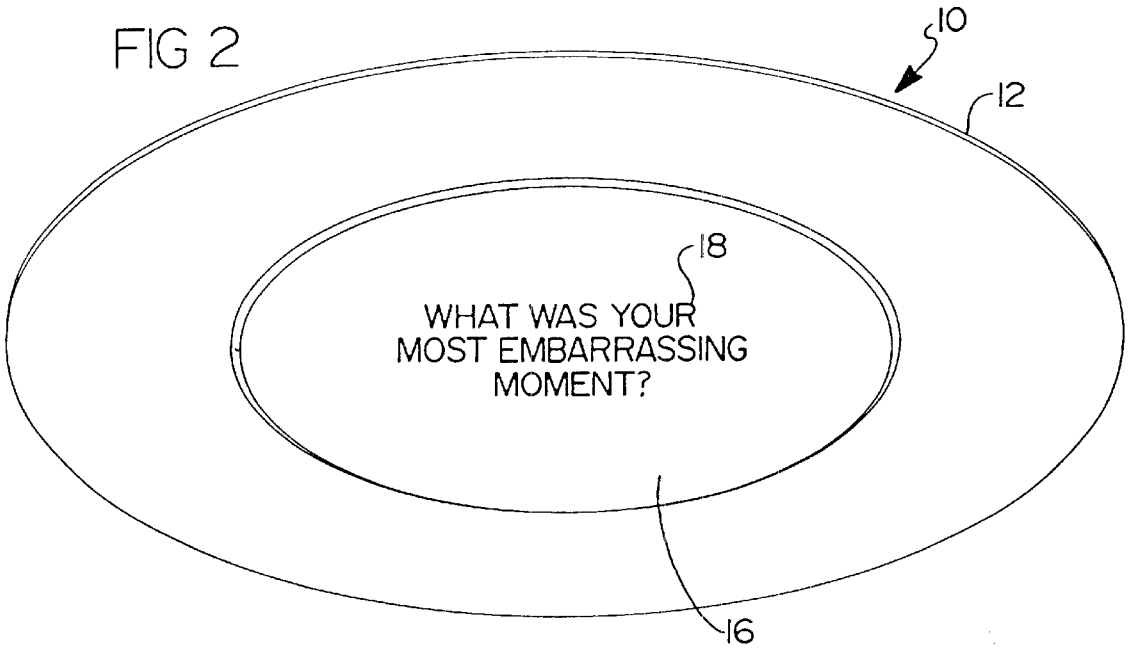
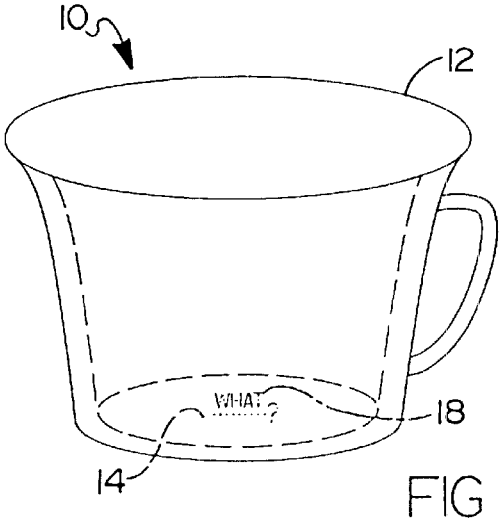
FIG 3

DINNER PARTY CONVERSATION GENERATOR

FIELD OF THE INVENTION

The present invention relates generally to tableware and, more particularly, to tableware pieces each having a question or command printed thereon for generating discussion among dining partners.

BACKGROUND OF THE INVENTION

Tableware, such as glasses, dishes, napkin rings, napkins, placemats, eating utensils, table decorations, party favors, and the like, are commonly used as service pieces for entertaining guests, such as at dinner parties and other social gatherings. Traditionally, each table setting includes multiple tableware pieces sufficient to serve multiple courses of a meal, such as an appetizer, a salad, soup, an entree, and a desert. However, such tableware may also be used in less formal situations for entertaining smaller groups of people.

While entertaining, it is common for hosts to attempt to facilitate conversation among their guests. However, this frequently develops into semi-private conversations among small sub-groups of individuals. These conversations often become superficial in nature. It is sometimes preferable to attempt to engage all guests in a group discussion to facilitate conversation among new acquaintances and/or promote the developments of new relationships. By way of non-limiting example, it is preferable to facilitate group discussion among guests during social picnics, dinner parties, brunches, or on retreats or cruises.

Accordingly, there exists a need in the relevant art to provide a method of facilitating, generating, or promoting conversation and discussion among dining partners. Furthermore, there exists a need in the relevant art to provide tableware that is capable of facilitating such conversation among dining partners.

SUMMARY OF THE INVENTION

In accordance with the broad teachings of this invention, tableware capable of facilitating conversation or discussion among guests and a method of using the same is provided. The method includes: a) providing a set of open-ended questions or commands each being separately printed on a surface of a dining-piece; b) distributing one or more of the dining-pieces to each dining partner; c) having each dining partner read aloud the open-ended question or comment printed on their dining-piece; d) having one of the dining partners answer the open-ended question; and e) engaging all of the dining partners in open discussion of alternate answers to the question.

Further areas of applicability of the present invention will become apparent from the detailed description provided hereinafter. It should be understood that the detailed description and specific examples, while indicating the preferred embodiment of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 2 is a bottom perspective view of a conversation generating apparatus having an open-ended question printed on an unexposed surface thereof according to the principles of the present invention; and FIG. 3 is a perspective view, with hidden sections, of another conversation generating apparatus having the open-ended question printed on an exposed surface thereof.

DETAILED DESCRIPTION OF THE PREFERRED EMBODIMENTS

Figure 1:
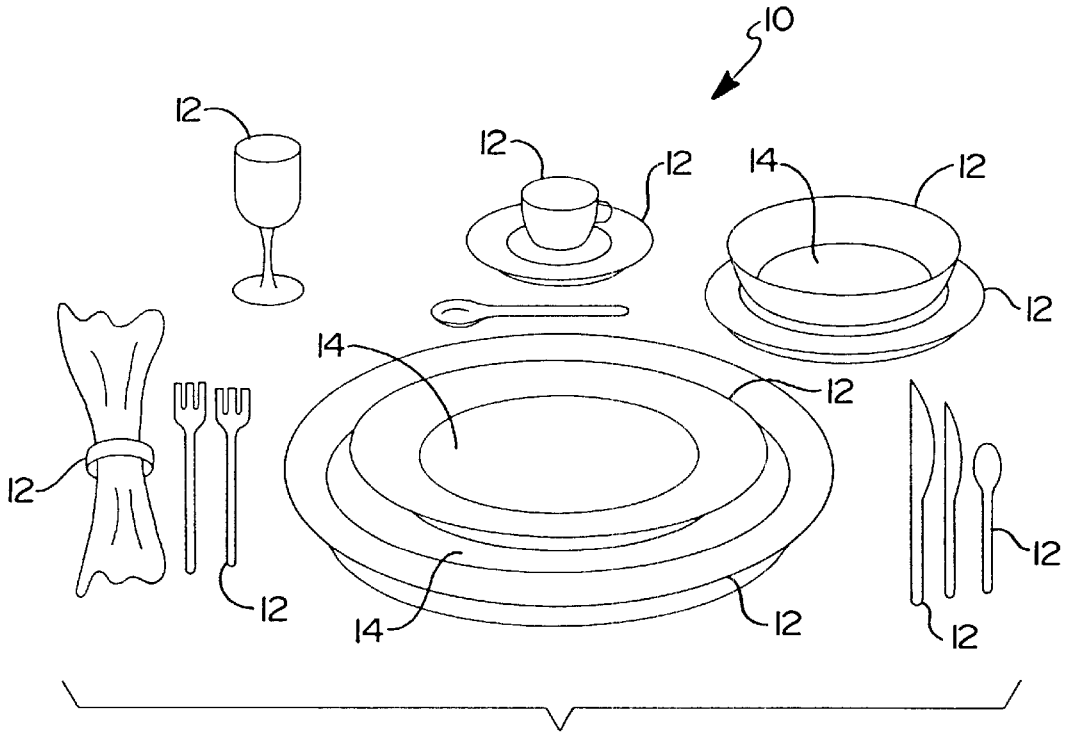
FIG. 1 is a perspective view of a table place setting for entertaining according to the principles of the present invention.

The following description of the preferred embodiment is merely exemplary in nature and is in no way intended to limit the invention, its application, or uses. For example, the present invention may be used during any meal, such as breakfast, brunch, lunch, dinner, supper, a picnic, or at any time a conversation or a discussion between dining partners is encouraged. Moreover, the present invention may find utility in various applications such as residential, commercial, corporate, cruise, and the like.

For purposes of this description, the term "tableware," "tableware piece," or "dining-piece" shall each include any plate, saucer, charger, bowl, cup, glass, goblet, napkin holder, napkin, placemat, table utensil, table decoration, party favor, and/or any other piece or item used in setting a table for a meal, such as breakfast, brunch, lunch, dinner, supper, a picnic, and the like. The terms "tableware," "tableware piece," or "dining-piece" may be used interchangeably. This tableware shall be made of conventional materials, such as china, earthenware, stoneware, porcelain, plastic, glass, silver, gold, steel, paper, expanded rigid polystyrene plastic such as STYROFOAM™, or any other material or composition commonly used in manufacturing formal, everyday, or disposable tableware products.

Referring to FIGS. 1–3, a conversation-generating apparatus 10 includes at least one tableware piece 12 defining a top or exposed surface 14 and a bottom or unexposed surface 16. Exposed surface 14 is generally exposed to the view of the user when tableware piece 12 is placed on a table and, in terms of a plate, would be the side in which food or other tableware is placed. On the other hand, unexposed surface 16 is generally concealed from the view of the user when tableware piece 12 is placed on a table and, again in terms of a plate, would be the non-food side that is placed downwardly. It is anticipated that conversation-generating apparatus 10 may include any number of tableware or dining pieces.

Each tableware piece 12 includes an open-ended question or command 18 printed on a surface thereof or otherwise affixed thereto. In the interest of brevity, open-ended question or command 18 will be referred to as open-ended question 18 unless otherwise noted. However, it should be appreciated that a command that instructs a guest to describe an experience, situation, opinion, or the like is within the scope of this invention.

Preferably, open-ended question 18 is printed on unexposed surface 16 of tableware piece 12 to prevent a user from reading the question or command prior to a discussion or conversation. However, open-ended question 18 may also be printed on exposed surface 14 of tableware piece 12 to be preferably covered by food or other tableware. It is anticipated that open-ended question 18 is printed on or affixed to tableware piece 12 in a known manner, such as by forming the lettering under a coating applied to the tableware piece either during or after the manufacturing process. This printing method would allow for a smooth, unobstructed, durable finish on the surface thereof. Such printing of open-ended question 18 in this manner also prevents the lettering from contaminating any food items placed on or in tableware piece 12. However, it should be appreciated that any printing or affixing method known to one skilled in the art may be used.

Open-ended question or command 18 is generally defined as a question or command that allows for a spontaneous, unstructured response that typically has no right or wrong answer. Open-ended questions or commands commonly allow a respondent to elaborate on their own personal thoughts, opinions, feelings, or experience relating to a specific topic. Preferably, open-ended question or command 18 is chosen from topics relating to politics, history, movies, theatre, sports, children, marriage, dating, religion, famous people, television, education, alma maters, space, general matters, personal experiences, festive occasions, and the like. It should be noted that open-ended question 18 may be any question which allows for a spontaneous, unstructured response. By way of non-limiting example, the following open-ended questions represent a varied cross-section of possible alternatives that are believed to elicit a spontaneous, unstructured response:

The use of conversation-generating apparatus 10 will now be described in further detail. As set forth above, the present invention may be used for a variety of entertaining situations. However, in the interest of brevity, the use of conversation generating apparatus 10 will be described with reference to a dinner party environment or other formal occasion. Place settings for formal dinner parties typically include the largest number of individual tableware pieces, such as plates, saucers, chargers, bowls, cups, glasses, goblets, napkin holders, napkins, placemats, table utensils, table decorations, party favors, and the like and, thus, provide the opportunity for the most complete description of the preferred embodiment. However, this detailed description shall not be interpreted to limit this application in that this invention may be used with a single tableware piece with a single open-ended question or command printed thereon.

To use conversation-generating apparatus 10, each guest or dining partner randomly receives a complete set of tableware defining a single place setting. Preferably, each piece of tableware 12 may include open-ended question or command 18 printed on unexposed surface 16. The printing of open-ended question or command 18 on unexposed General Category 1.) If you could invite a person in history to have dinner with you, who would it be and what would you discuss?
2.) Which relative or acquaintance makes you want to "run for cover," when they announce they are coming for a visit . . . and why?

Politics and History

1.) Which U.S. political figure has made the most important contribution to our society and what was that contribution?
2.) Which top five inventions have made the most impact on our culture?

Movies and Theater

1.) If you could spend a weekend "on location" during the filming of a movie with your favorite actor, who would it be?
2.) What movie should be a requirement for all children to see?

The Sporting Life

1.) Choose a sport and describe how certain aspects of the sport mimic life and its uncertainties.
2.) Which American athlete presents the best qualities of a role model for youth and why?

Children

1.) What did you do to receive the most memorable punishment of your life?
2.) You are getting ready to leave for school, what do you hear your Mom or Dad saying?

Dating Fun

1.) What was your worst date?
2.) What physical characteristics do you appreciate most in a potential date?

Married Life

1.) You are talking to a young person about to marry, what three pieces of advice do you give?
2.) What was the funniest event that occurred during your wedding and/or on your honeymoon?

Spiritual

1.) Which verse provides you with the most inspiration for dealing with life's difficulties?
2.) You and God are dining, what do you say to Him and what does He say to you?

Preferably, each guest receives at least one tableware piece 12. This tableware piece would include a unique open-ended question 18 that is unlike any of the remaining open-ended questions.

surface 16 prevents each guest from knowing his/her questions. This prevents each guest from knowing and preparing a response to the open-ended question beforehand. Consequently, the intent of eliciting spontaneous, unstructured answers and opinions is maintained. However, it is anticipated that in the alternative, open-ended question or command 18 may be printed on exposed surface 14 of tableware 12. When these questions or commands are printed on exposed surface 14, they may be obscured from view by food or beverage or may be revealed to the guest upon sitting at the table. The specific time at which the open-ended questions or commands are revealed to the guest may be determined by the host and may be tailored to suite the desired atmosphere of the social gathering.

At a time to be determined by the host, each guest or dining partner is asked to uncover, if necessary, the open-ended question or command that is printed on a specific piece of tableware and read it aloud to the remaining dining partners. This is preferably done prior to the serving of the next course. The guest then answers the open-ended question or command aloud, thereby sharing with the remaining dining partners their own thoughts, opinions, feelings, and/or experiences relating to the topic. The remaining dining partners are then engaged in a group discussion relating to the open-ended question or command and/or the answer(s) provided by their fellow dining partner(s). Once the group discussion is substantially exhausted or at a time determined by the host, another guest is asked to read aloud and answer aloud the open-ended question or command printed on one of their specific pieces of tableware and the process is repeated for each guest.

Alternatively, one guest may read the open-ended question or command, while another guest responds to the question or command. It is important to note that there may be variations to this method that are within the scope of this application which still provide for eliciting a spontaneous, unstructured response to facilitate conversation among guests.

By providing each guest with multiple tableware pieces having a different open-ended question or command printed thereon, each guest may have multiple turns of reading aloud and answering aloud their specific questions or command. It is also anticipated that the present invention may be used by two or more dining partners. For example, the present invention may be particularly useful in quickly getting to know the personal opinions and/or experiences of someone that one is dating or seeking to employ.

The invention being thus described, it will be obvious that the same may be varied in many ways, such as with some editions centered on a certain theme and/or limits on production volumes. Such variations are not to be regarded as a departure from the spirit and scope of the invention. Such variations or modifications, as would be obvious to one skilled in the art, are intended to be included within the scope of the following claims.

What is claimed is:

1. A method of facilitating conversation between at least two dining partners, comprising the steps of:

a) providing a set of open-ended questions each being separately printed on a surface of a dining-piece used by one of said dining partners to assist in dining;

b) distributing one or more of the dining-pieces to each dining partner;

c) having each dining partner read aloud the open-ended question printed on their dining-piece in accordance with a prompt from one of said dining partners;

d) having one of the dining partners answer aloud said open-ended question; and e) engaging at least one other of the dining partners in open discussion of alternative answers to said question.

2. The method of generating conversation according to claim 1 wherein said providing a set of open-ended questions each being separately printed on said surface of said dining-piece includes printing each of said open-ended questions on an unexposed surface of said dining-piece.

3. The method of generating conversation according to claim 1 wherein said distributing of one or more dining-pieces to each dining partner is randomly.

4. A method of promoting discussion between dining partners, comprising the steps of:

a) providing tableware used by one of said dining partners to assist in dining having an open-ended question printed on a surface thereof;

b) distributing said tableware to at least one of the dining partners;

c) having each dining partner read aloud said open-ended question printed on their respective tableware;

d) having one of the dining partners answer aloud said open-ended question in accordance with an instruction from a host; and e) engaging all of the dining partners in open discussion regarding said open-ended question.

5. The method of promoting discussion according to claim 4 wherein said providing tableware having an open-ended question printed on said surface of said tableware includes printing each of said open-ended questions on an underside of said tableware.

6. A method of facilitating conversation between at least two dining partners, comprising the steps of:

a) providing tableware used by one of said dining partners to assist in dining having an open-ended question printed on a surface thereof;

b) distributing said tableware to at least one of the dining partners;

c) having each dining partner read aloud the open-ended question printed on their dining-piece in accordance with a prompt from one of said dining partners;

d) having one of the dining partners answer aloud the open-ended question; and e) engaging at least one other of the dining partners in open discussion of alternate responses to the open-ended question.

7. The method of generating conversation according to claim 6 wherein said providing tableware having said open-ended question printed on a surface thereof includes printing each of said open-ended questions on an unexposed surface of said tableware.

8. A method of facilitating conversation between at least two dining partners, comprising the steps of:

a) providing a set of open-ended questions each being separately printed on a surface of a dining-piece adapted to be presented in an unexposed manner;

b) covering said surface of said dining piece adapted to be presented in an unexposed manner;

c) distributing one or more of the dining-pieces to each dining partner;

d) having each dining partner read aloud the open-ended question printed on their dining-piece by exposing the previously unexposed surface thereof in accordance with an instruction from a moderator;

d) having one of the dining partners answer aloud said open-ended question; and e) engaging at least one other of the dining partners in open discussion of alternative answers to said question.

9. The method of claim 8, wherein said distributing of one or more dining-pieces to each dining partner is random.

10. The method of claim 8, wherein a host instructs which of said dining partners is to read aloud the open-ended question printed on their dining-piece.

11. The method of claim 8, wherein said surface of said dining-piece adapted to be presented in an unexposed manner comprises an underneath surface of said dining-piece.

12. The method of claim 8 wherein said surface of said dining-piece adapted to be presented in an unexposed manner comprises an area of an upper surface of said dining-piece adapted to be hidden by food or the like.

13. A method of promoting discussion between dining partners, comprising the steps of:

providing tableware having an open-ended question printed on a surface thereof adapted to be presented in an unexposed manner;

distributing said tableware to at least one of the dining partners;

having each dining partner read aloud said open-ended question printed on their respective tableware in accordance with a prompt from one of said dining partners;

having one of the dining partners answer aloud said open-ended question; and engaging all of the dining partners in open discussion regarding said open-ended question.

14. A method of facilitating conversation between at least two dining partners, comprising the steps of:

providing tableware having a command printed on a surface thereof adapted to be presented in an unexposed manner;

distributing said tableware to at least one of the dining partners; and having each dining partner read aloud the open-ended question printed on their dining-piece in accordance with a prompt from one of said dining partners;

having one of the dining partners answer aloud said open-ended question; and engaging all of the dining partners in open discussion regarding said open-ended question.

15. A method of facilitating conversation between at least two dining partners, comprising the steps of:

providing a set of open-ended questions each being separately printed on a surface of a dining-piece;

distributing one or more of the dining pieces to each dining partner;

having each dining partner read aloud the open-ended question printed on the dining piece upon instructions from a moderator;

having one of the dining partners answer aloud said open-ended question upon instruction from said moderator; and engaging at least one other of the dining partners in open discussion of alternate answers to said questions upon instruction from said moderator.

16. The method of generating conversation according to claim 15, wherein said set of open-ended questions are each printed on a surface of each of said dining-pieces adapted to be presented in an unexposed manner.

17. The method of claim 15, wherein said distributing of one or more dining-pieces to each dining partner is random.

18. A method of promoting discussion between dining partners, comprising the steps of:

providing tableware having an open-ended question printed on a surface thereof;

distributing said tableware to at least one of the dining partners;

having each dining partner read aloud said open-ended question printed on their respective tableware upon instruction from a moderator;

having one of the dining partners answer aloud said open-ended question upon instruction from a moderator; and engaging all of the dining partners in open discussion regarding said open-ended question.

19. The method of generating conversation according to claim 18, wherein said open-ended question is printed on a surface of said dining-piece adapted to be presented in an unexposed manner.

20. A method of facilitating conversation between at least two dining partners, comprising the steps of:

providing tableware having a command printed on a surface thereof;

distributing said tableware to at least one of the dining partners;

having each dining partner read aloud the command printed on their dining piece in accordance with an instruction from a moderator;

having at least one of the dining partners answer aloud the command in accordance with an instruction from a moderator; and engaging at least one other of the dining partners in open discussion of alternate responses to the command.

21. The method of generating conversation according to claim 20, wherein said command is printed on a surface of said dining-piece adapted to be presented in an unexposed manner.

22. A method of facilitating conversation between at least two dining partners, comprising the steps of:

a) providing a set of open-ended questions each being separately printed on a surface of a plate adapted to be presented in an unexposed manner used by one of said dining partners to assist in dining;

b) covering said surface of said plate adapted to be presented in an unexposed manner;

c) distributing one or more of the plates to each dining partner;

d) having each dining partner read aloud the open-ended question printed on their plate by exposing the previously unexposed surface thereof upon instructions from a moderator; and e) engaging at least one other of the dining partners in open discussion of alternative answers to said questions upon instruction from said moderator.

23. The method of claim 22, wherein said distributing of one or more plates to each partner is random.

24. The method of claim 22, wherein said surface of said plate adapted to be presented in an unexposed manner comprises an underneath surface of said plate.

25. The method of claim 22, wherein said surface of said plate adapted to be presented in an unexposed manner comprises an area of an upper surface of said plate adapted to be hidden by food or the like.

* * * * *